US006094750A

United States Patent [19]

Lee

[11] Patent Number: 6,094,750

[45] Date of Patent: Aug. 1, 2000

[54] MODIFIED SAFETY HELMET HEAT SINK

[75] Inventor: Te Lung Lee, Tainan Hsien, Taiwan

[73] Assignee: Lung Huei Safety Helmet Co., Ltd., Tainan Hsien, Taiwan

[21] Appl. No.: 09/283,329

[22] Filed: Mar. 31, 1999

[51] Int. Cl.[7] ..... A42B 3/00

[52] U.S. Cl. ..... 2/412; 2/414; 2/171.3

[58] Field of Search ..... 2/410, 411, 412, 2/414, 424, 425, 171.3

[56] References Cited

U.S. PATENT DOCUMENTS

| | | | |
|---|---|---|---|
| 4,081,865 | 4/1978 | Bergee et al. | 2/425 |
| 4,821,344 | 4/1989 | Kamata | 2/414 |
| 4,970,729 | 11/1990 | Shimazaki | 2/414 |
| 5,090,054 | 2/1992 | Grilliot et al. | 2/5 |
| 5,204,998 | 4/1993 | Liu | 2/411 |
| 5,337,420 | 8/1994 | Haysom et al. | 2/410 |
| 5,493,736 | 2/1996 | Allison | 2/416 |
| 5,974,593 | 11/1999 | McNabb | 2/418 |

*Primary Examiner*—Michael A. Neas

*Attorney, Agent, or Firm*—Pro-Techtor International Services

[57] ABSTRACT

A heat sink structure of a safety helmet includes an inner helmet provided inside the helmet shell; a lining provided inside said inner helmet with the top of said lining indicating an opening; and a resilient provided between said inner helmet and said lining, with an air circulation space formed between the resilient mesh and the inner helmet; said resilient mesh holds against the top of the rider's head and contacts the rider's forehead allowing the cooler, ambient air(wind) enter into said air circulation space through the gap between the rider's forehead and the mesh to form a free circulation of air, resulting in good air ventilation and heat dissipation, so that the rider feels easy and comfortable wearing the safety helmet.

2 Claims, 7 Drawing Sheets

MODIFIED SAFETY HELMET HEAT SINK

BACKGROUND OF THE INVENTION

The present invention relates to a modified heat sink structure of a safety helmet, more particularly, to one with good air ventilation and heat dissipation while making a safety helmet comfortable to wear.

The prior art of a safety helmet heat sink is essentially comprised of ventilation ducts; however, the air ventilation expected from such ducts serving as heat sink is impeded by a lining, substantially made of warmth retaining materials, namely, velveteen and foamed plastics, provided in and tightly attached to the polystyrene inner helmet to improve the wearing comfort, a rider wearing such a helmet thus feel hot and discomfort, even with hair style ruined.

BRIEF DESCRIPTION OF THE DRAWINGS

The primary purpose of the present invention is to provide a heat sink structure with good air ventilation and heat dissipation results for a safety helmet.

Another purpose of the present invention is to provide a heat sink structure for a safety helmet resilient and comfortable for the rider to wear.

Figure 1:
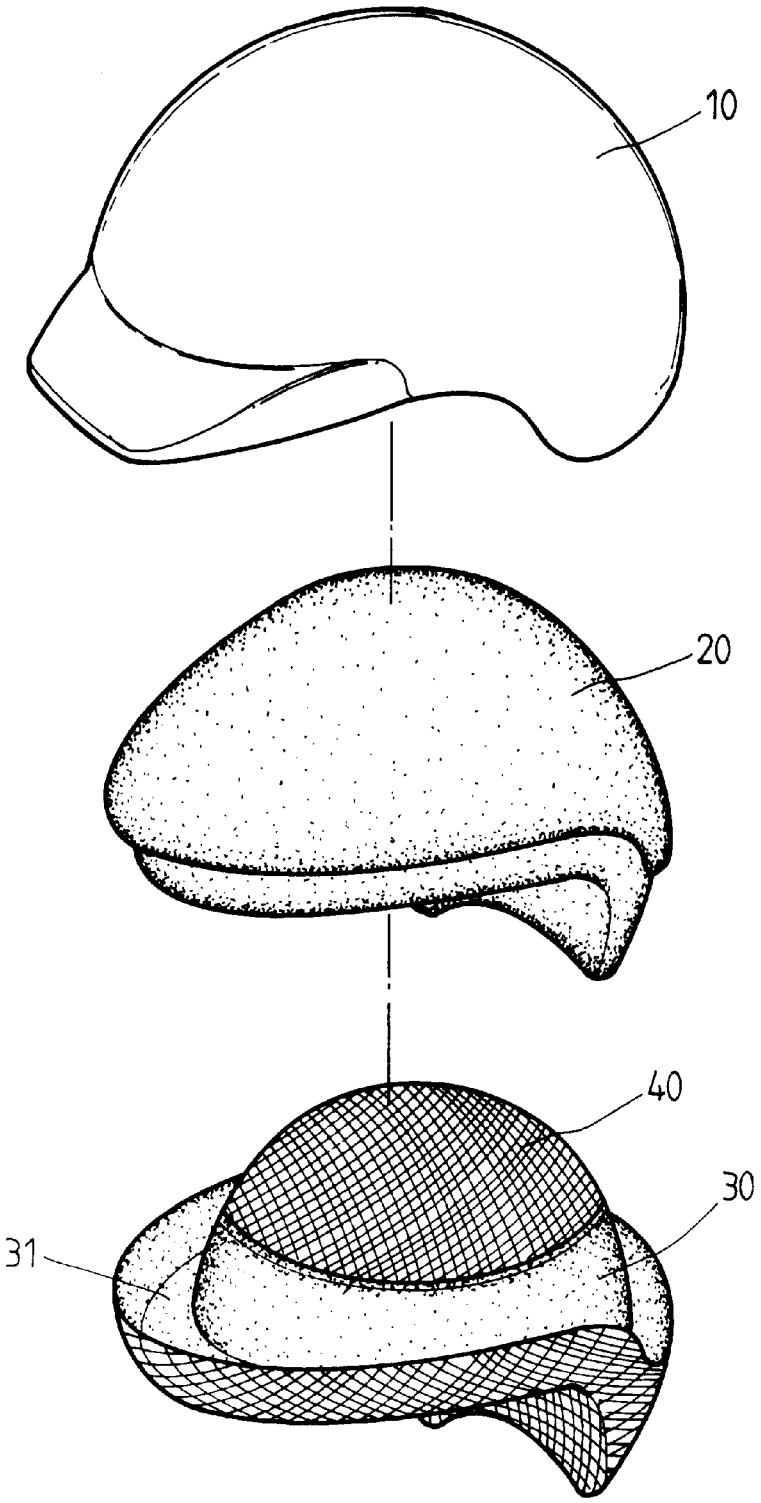
Figure 2:
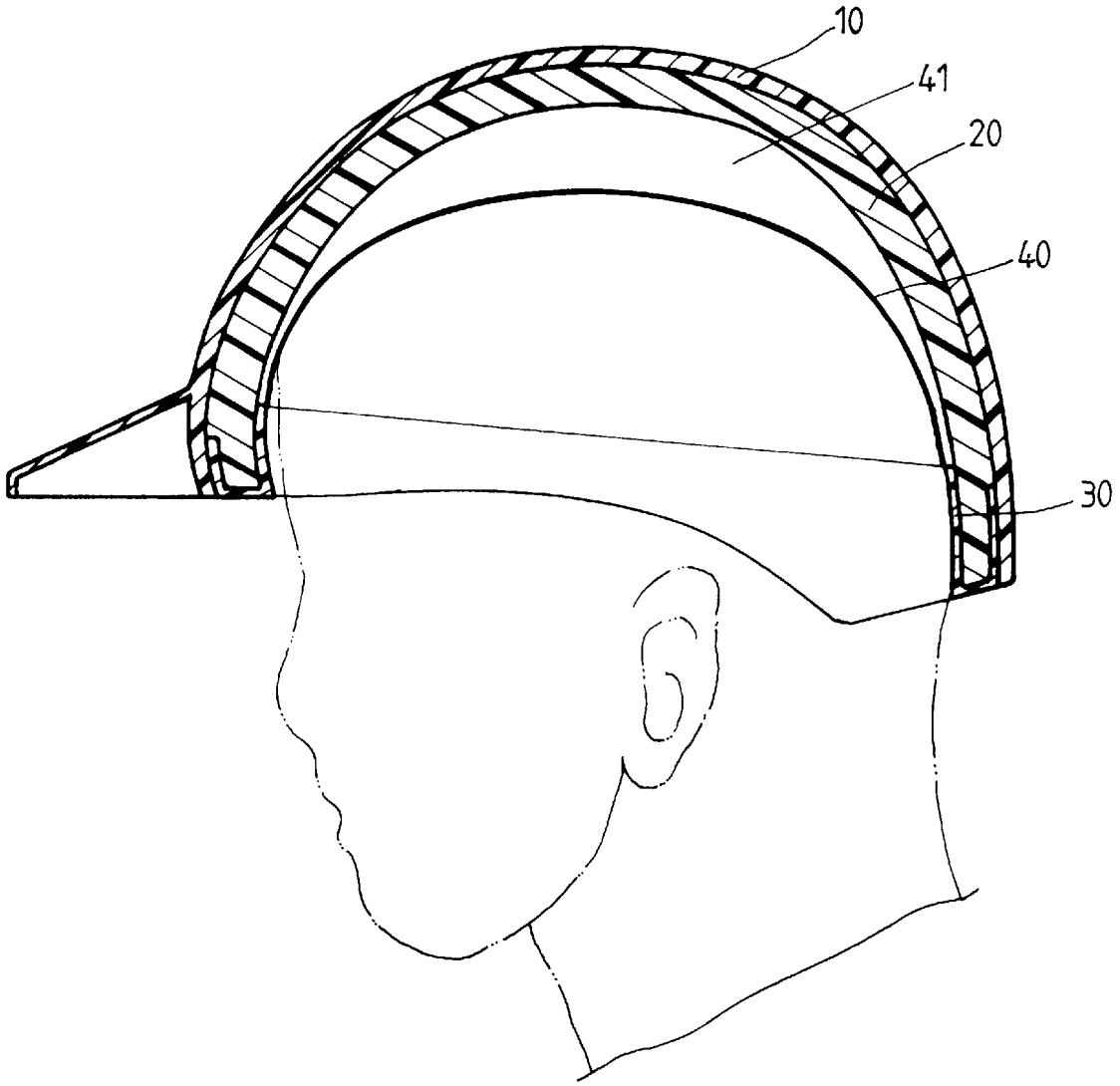
Figure 3:
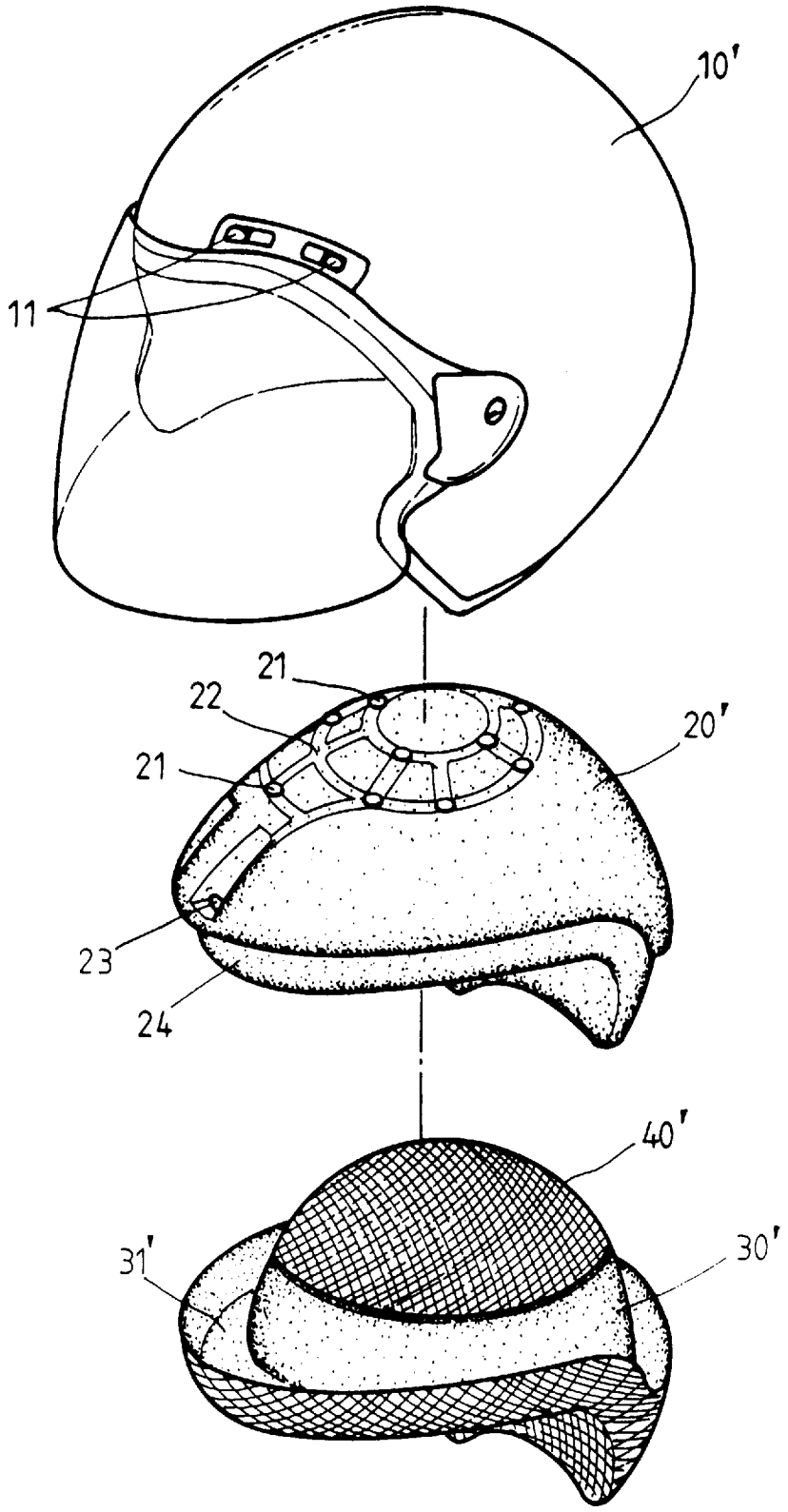
Figure 4:
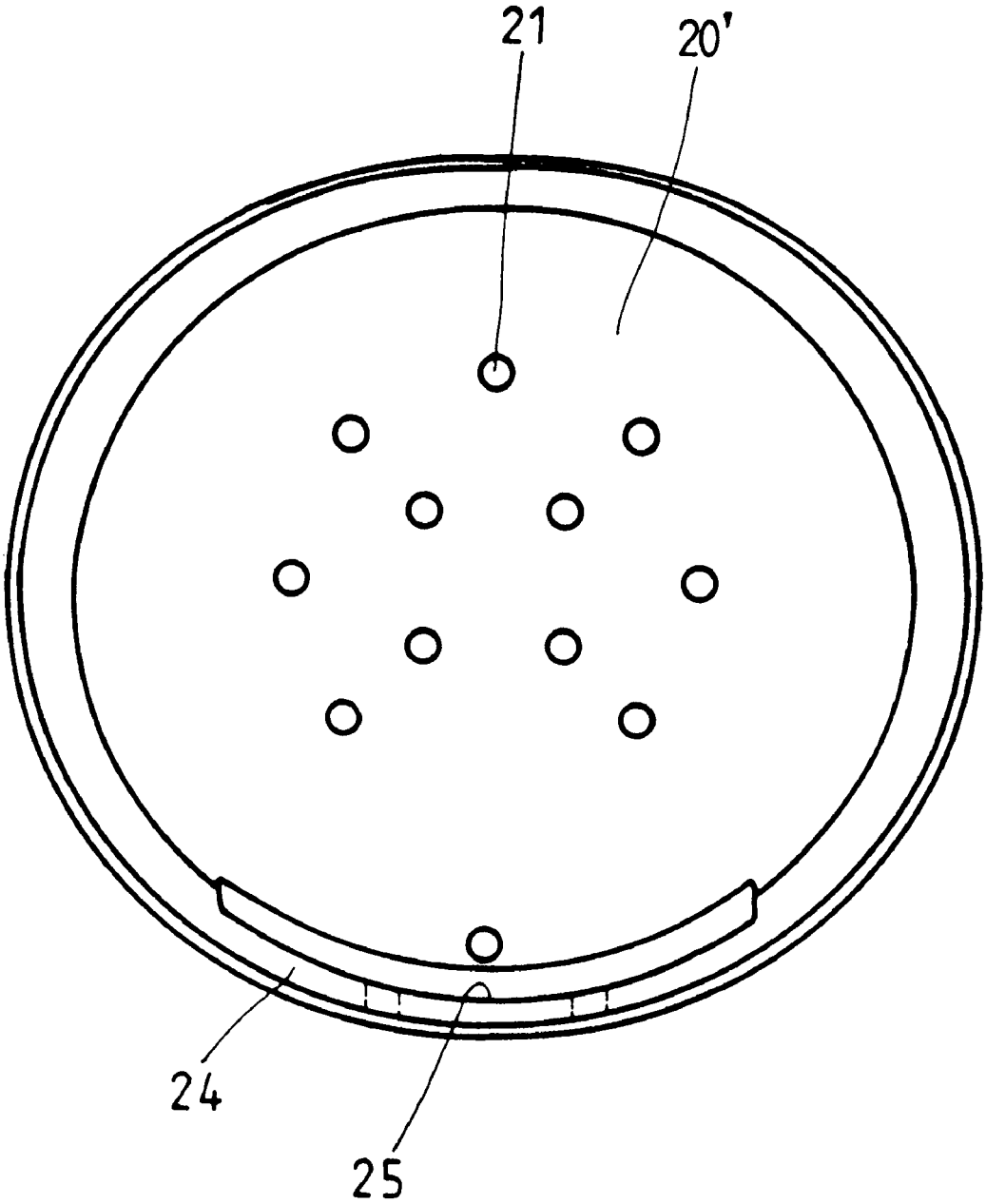
Figure 5:
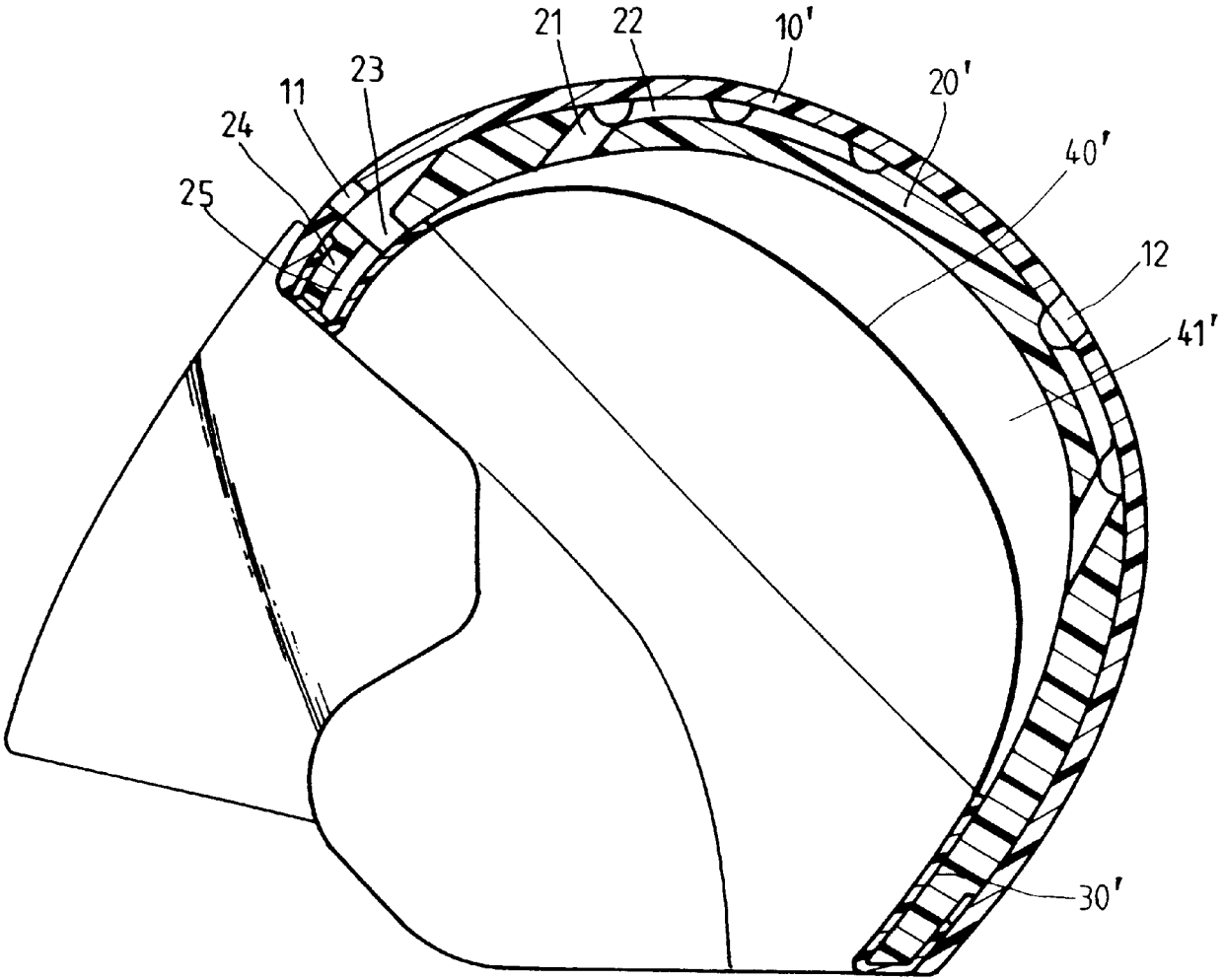

To achieve the aforesaid purposes, technical means and physical structure of the present invention can be better understood by two preferred embodiments in conjunction with the following drawings:

FIG. 1 is a perspective view illustrating the first preferred embodiment of the present invention;

FIG. 2 is a front elevation view of the first preferred embodiment of the present invention;

FIG. 3 is a perspective view of the second preferred embodiment of the present invention when assembled;

FIG. 4 is a perspective view illustrating the second preferred embodiment of the present invention; and FIG. 5 is a sectional view of the second preferred embodiment of the present invention when assembled.

Figure 6:
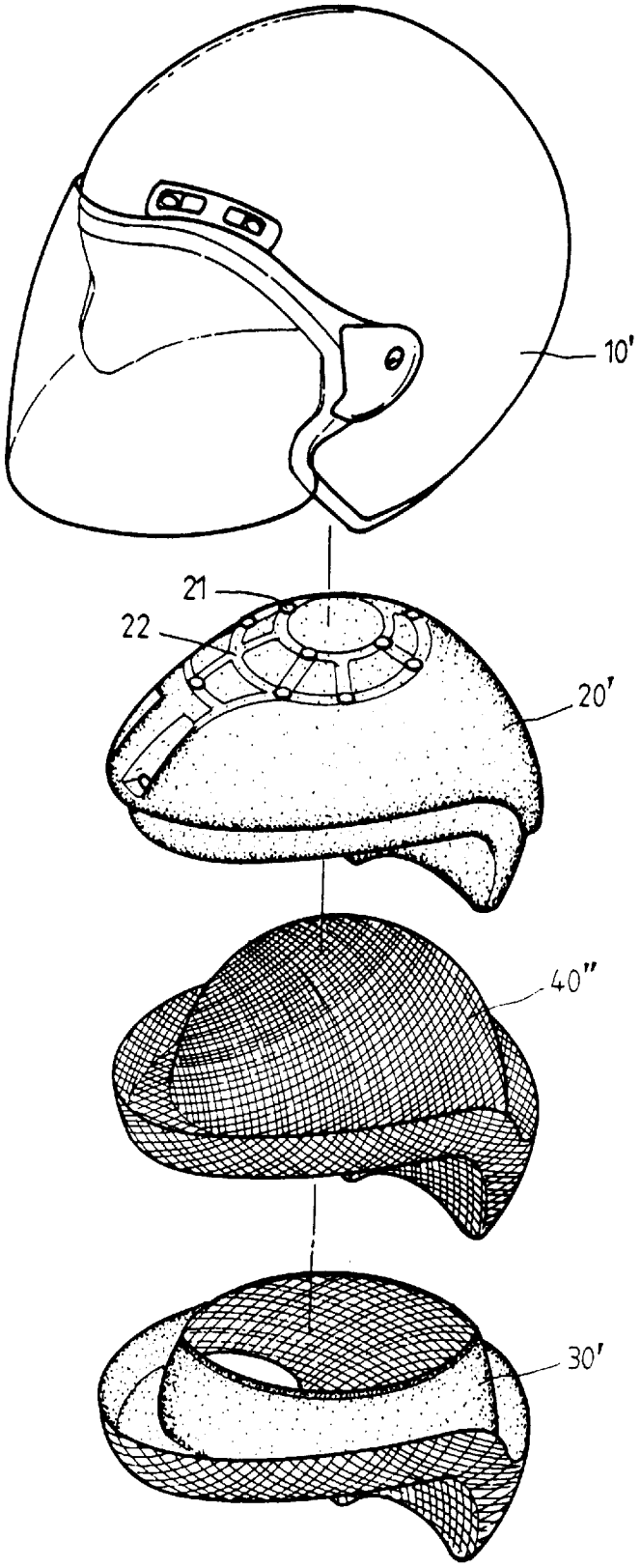
Figure 7:
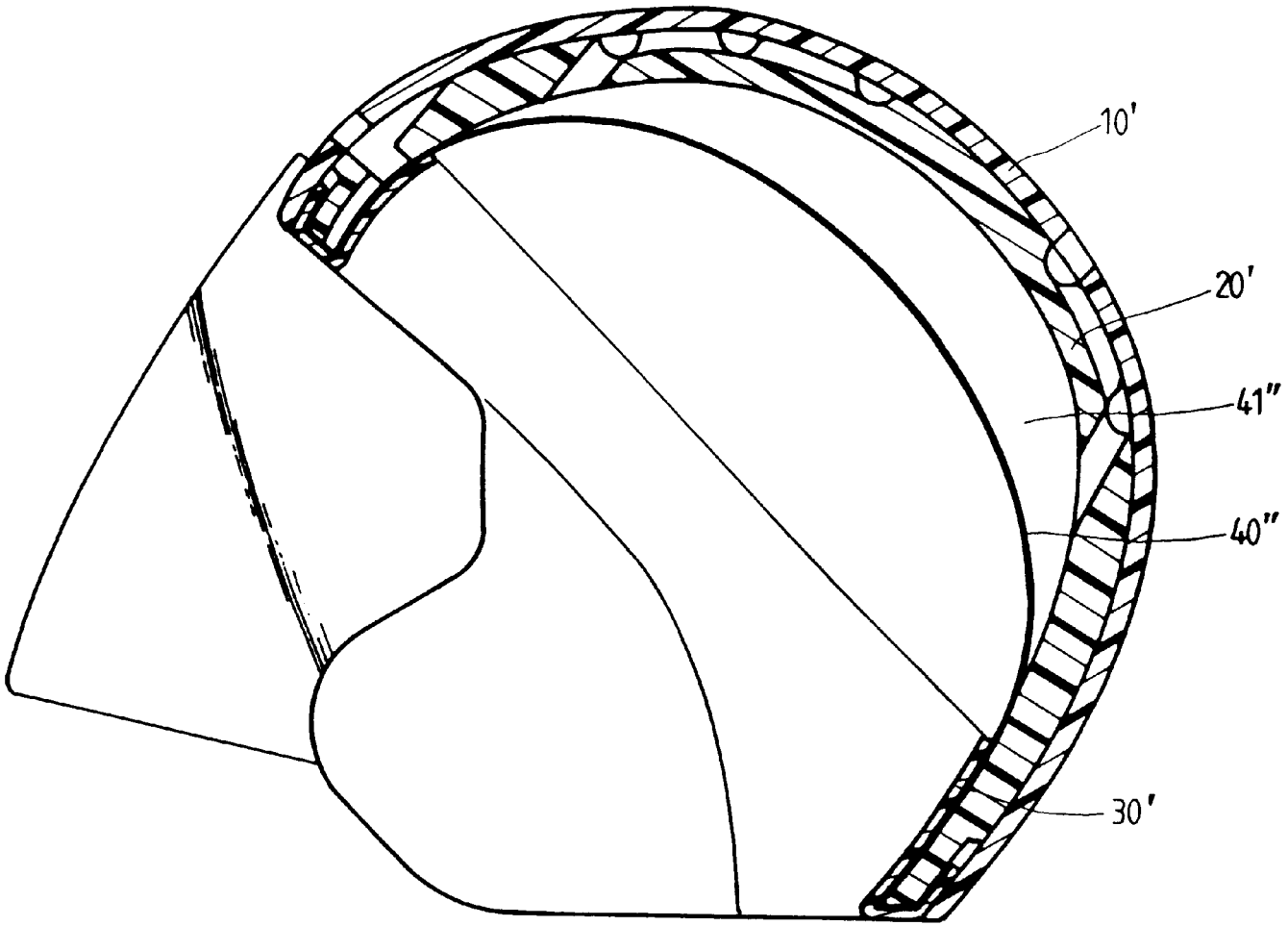

FIG. 6 is a perspective view illustrating the third preferred embodiment of the present invention; and FIG. 7 is a sectional view of the third preferred embodiment of the present invention when assembled.

DESCRIPTION OF THE PREFERRED EMBODIMENTS:

Referring to FIGS. 1 and 2, the first preferred embodiment of the present invention relates to a semi-coverage safety helmet, essentially comprised of a helmet shell 10; an inner helmet 20, made of polystyrene and provided inside said shell 10; a lining 30, made of refractory materials of fabrics and foamed plastics either by sewing work or thermally pressed, is provided inside said inner helmet 20, and at the bottom of the lining 30, a snap-on trunk 31 with its top permitting an opening to receive the bottom edge of said inner helmet 20; and a resilient mesh 40, made of nylon or PVC material in the form of a mask with multiple fine grids is provided between the inner helmet 20 and the lining 30 keeping a certain clearance 41 from said inner helmet 20 to create an air circulation space. In the first preferred embodiment of the present invention, said mesh 40 is sewn to the top of said lining 30 to be in place above said opening at the top of the lining 30.

As illustrated in FIG. 2, the first preferred embodiment of the present invention is completed with its assembly so that when worn by a rider, the top of the head of the rider is against said mesh 40 above said lining 30, and the top of his forehead contacts said mesh 40 while the main portion of his forehead does not contact said mesh 40 so that a gap is formed between said mesh 40 and said lining 30, so that the cooler, ambient air (wind) enters into said air circulation space 41 through the gap between the forehead of the rider and the lining 30 to form a free air circulation and drive away the internal hotter air out of the gap between said lining 30 and the head of the rider, to give the interiors of the safety helmet good air ventilation and heat dissipation results for the rider to feel easy and comfort when wearing the safety helmet.

Now referring to FIGS. 3 and 5, the second preferred embodiment of the present invention relates to a full coverage of a safety helmet, is comprised of a helmet shell 10', a multiple of ventilation windows 11 that can be opened or closed are provided on the front end and an air outlet 12 is provided on the rear end of said helmet shell 10'; an inner helmet 20', made of polystyrene material, is provided inside the helmet shell 10', a multiple of ventilation outlets 21 and ducts 22 connected to one another are provided on the inner helmet 20' while a multiple of ventilation inlets 23 are provided at the front end of said ventilation outlets 21 and ducts 22 so to align to the corresponding ventilation window 11 on the helmet shell 10'; a lining 30', made of nylon or PVC material in the form of a mesh mask given with a multiple of grids, is provided between the inner helmet 30' and the lining 30' while keeping a proper space 41 from said inner helmet 20', so to form a space connected through those ventilation outlets 21. In this preferred embodiment of the present invention, said mesh 40' is sewn to the top of said lining 30' over the top of the opening in said lining 30'.

As illustrated in FIG. 5, the second preferred embodiment of the present invention is completed with its assembly so that when worn by a rider, the top of the head of the rider is against said mesh 40' above said lining 30', and his forehead contacts said mesh 40', so that the cooler, ambient air (wind) enters from those ventilation inlets 23 on the inner helmet 10' from those ventilation windows 11 at the front end of the helmet shell 10, and from the gap provided between the head of the rider and the lining 30', into those ventilation inlets 21 and ducts 22, as well as a space 41' which is connected to said ventilation inlets 21 to form a free air circulation and drive away the internal hotter air through said air outlet 12 at the read end of the helmet shell 11, and the gap between said lining 30 and the head of the rider, to give the interiors of the safety helmet good air ventilation and heat dissipation results for the rider to feel easy and comfort when wearing the safety helmet.

Referring to FIG. 4, a recess 25 is provided in the inner side of the front end to the protection area 24 to the inner helmet 20' (inner helmet is divided into the protection area and a test area according to Safety Helmet Inspection Standard). Said recess 25 permits a clearance in the frontage of said inner helmet 20' and said lining 30' (i.e. at the forehead of the rider wearing the safety helmet) to help guide the entrance of the air (wind) for achieving better air ventilation and heat dissipation results, thus the rider will not develop a sweaty forehead when riding with the safety helmet on.

As disclosed above, the first embodiment of the present invention gives the following advantages and results:

(1) Excellent air ventilation and heat dissipation results: are achieved by the mesh 40 with excellent air permeability provided above the lining 30, and between said mesh 40 and the inner helmet 20 said circulation space 41 to achieve good ventilation and heat dissipation effects inside the safety helmet.

(2) The rider feels easy and comfortable to wear the safety helmet since said resilient mesh 40 is attached to the top of the head of the rider, with the excellent air circulation space 41 provided above said mesh 40 so that the rider will not be annoyed by the excessive heat usually found in the prior art of a safety helmet.

(3) Said mesh 40 is nicely compromised to the top of the head of the rider as were a hair mask, so that the hair style of the rider will stay intact when the safety helmet is removed.

Referring to FIGS. 6 and 7, the third preferred embodiment of the present invention is also comprised with a helmet shell 10', an inner helmet 20', a lining 30' and a resilient mesh 40" similar to those counterparts as disclosed in the second preferred embodiment; provided, however, that the mesh 40" is adhered to the outer base edge of the inner helmet 20' before being inwardly positioned in recess in said inner helmet and over a hollow portion of said lining 30' while keeping a ventilation space 41" between said inner helmet 20' so to permit the same ventilation and heat dissipation effects as that by the second preferred embodiment of the present invention.

I claim:

1. A safety helmet with a heat sink included therein, comprising:

an inner helmet inside a shell of said safety helmet;

a lining, provided inside said inner helmet, a top of said lining includes an opening; and a resilient mesh is positioned to cover said opening of said lining, said resilient mesh is spaced from said inner helmet to create an air circulation space, said resilient mesh contacts a top of a rider's head and contacts a top end of the rider's forehead allowing ambient air to enter into said air circulation space through a gap between the main portion of the rider's forehead and the resilient mesh to allow free circulation of air, thereby resulting in good ventilation and heat dissipation, so that the rider feels comfortable wearing said safety helmet.

2. The safety helmet as claimed in claim 1, wherein, said mesh covers an upper surface of said lining.

* * * * *